United States Patent [19]

Romanowski

[11] 4,074,095

[45] Feb. 14, 1978

[54] FLOW OPERABLE SWITCH DEVICE

[75] Inventor: Robert F. Romanowski, Rochester, N.Y.

[73] Assignee: Qualitrol Corporation, Fairport, N.Y.

[21] Appl. No.: 722,010

[22] Filed: Sept. 10, 1976

[51] Int. Cl.[2] ..... H01H 35/40

[52] U.S. Cl. ..... 200/81.9 M; 200/331; 335/205

[58] Field of Search ..... 335/205; 340/239 R, 340/240, 244 D; 200/330, 331, 81 R, 81.9 R, 81.9 M, 82 E, 84 C

[56] References Cited

U.S. PATENT DOCUMENTS

| | | | |
|---|---|---|---|
| 1,747,758 | 2/1930 | Despard | 200/331 |
| 2,963,563 | 12/1960 | Patterson | 200/81.9 M |
| 3,446,986 | 5/1969 | Cox | 200/81.9 M |

*Primary Examiner*—Gerald P. Tolin
*Attorney, Agent, or Firm*—Stephen J. Rudy

[57] ABSTRACT

A switch device having a housing connectible to a side wall of a flow conduit, a cup element dangling at the end of a string in the conduit is adapted under a predetermined pressure of fluid flowing through the pipe to draw a magnet connected in the housing at the other end of the string against the bias of a spring away from a read switch so as to move the contacts of the latter from one condition to another.

5 Claims, 3 Drawing Figures

FIG. 1
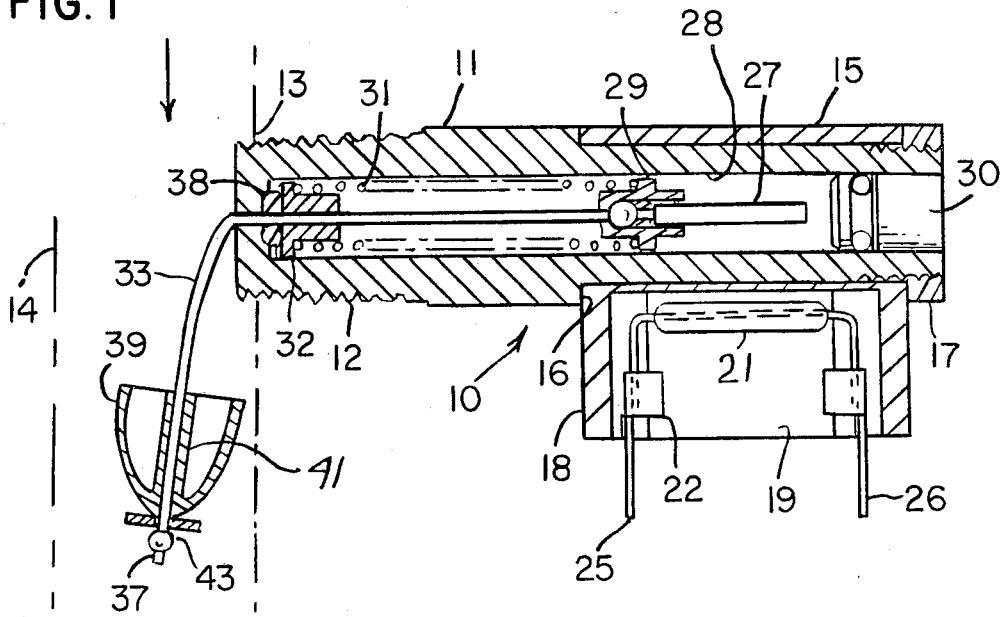
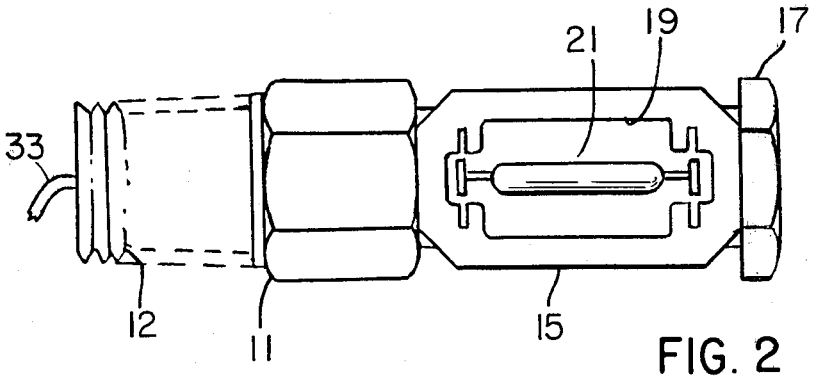
FIG. 2
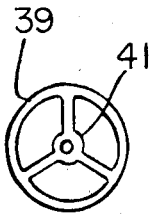
FIG. 3

FLOW OPERABLE SWITCH DEVICE

BACKGROUND OF THE INVENTION

This invention is concerned with a flow operable switch device.

It is designed for association with a conduit; and is connectible in an electric signal circuit. Its function is to signal the circuit when fluid of a predetermined volume is flowing through the conduit.

A feature of the switch device lies in the manner in which it is associated with the conduit and in the manner in which it is caused to be actuated to open and closed conditions.

It includes a reed switch which is adapted to be opened or closed accordingly as the flux of a magnet is brought into a zone where it will influence the contacts of the reed switch or is withdrawn from such zone. The magnet is adapted to be normally positioned in the zone of influence under the bias of a spring; and is adapted to be drawn from such zone by pressure of liquid flow through the conduit acting upon a cup attached by a cordline to the magnet.

A desirable advantage of the switch device of the present invention is that its switch elements and the magnet are located externally of, and are not subject to, the harmful effects of the liquid flowing in the conduit.

In accordance with the invention, there is provided a flow operable switch device comprising a housing, a reed switch mounted to the housing having magnetically attractible contacts, a magnet movable in an elongated bore of the housing into and out of a zone of effective magnetic flux influence upon the contacts of the switch, a spring biasing the magnet into the zone, a string connected to the magnet and projecting externally of the housing, and a pull element connected to the projecting end of the string adapted under a predetermined force applied to it in a direction away from the housing to draw the magnet out of said zone.

BRIEF DESCRIPTION OF THE DRAWING

In the accompanying drawing:

FIG. 1 shows in longitudinal section a flow operable switch device embodying the invention as applied to a conduit;

FIG. 2 is a bottom plan view of FIG. 1; and

FIG. 3 is a plan view of the top end of the cup element.

DESCRIPTION OF A PREFERRED EMBODIMENT OF THE INVENTION

The switch device 10 illustrated in the accompanying drawing as embodying the invention includes for its body or housing an elongated tube 11. The latter has a threaded end 12 whereby the device is adapted to be connected in a complementary aperture 13 of a side wall of a fluid conducting pipe or conduit 14 (broken line). When so connected, it will extend at right angles to the conduit.

A collar or sleeve 15 is fitted on a rear portion of the body. It is held in a fixed position on the body against an abutment 16 by means of a collar nut 17. The collar has a radially enlarged extension 18 providing a recess 19 in which an electric reed switch 21 is anchored, as by clips 22.

The switch has a pair of magnetically attractible leaf spring contacts. The latter are connected by terminals 25, 26 in a control electric circuit. The circuit may include an indicator to indicate the volume of liquid flow through the conduit to which the device is applied, or a flow shut-off control, or other suitable signal indicator.

The contacts are adapted to close or open the circuit accordingly as they are influenced by the flux of a bar magnet 27.

The magnet is disposed in a longitudinally extending hollow or bore 28 of the tube. It is fixed as by cement at its forward end to a headpiece 29 that is disposed in the bore for relative sliding movement. A plug 30 seals up the rear end of the bore.

A compression spring 31, limited between the head piece of the magnet and an opposed stop or bushing 32, biases the magnet to a normal position at the rear of the bore (as in FIG. 1) where the magnet is in parallel alignment with and below the switch contacts. In this position of the magnet, the contacts are within the flux zone or influence of the magnet and, accordingly, are drawn together closing the external control circuit.

Bore 28 is sufficiently long enough to enable the magnet to be drawn forwardly from its normal rear position to an area of the bore where its flux does not influence the contacts. When such is the case, the contacts spring back or return to an open condition, breaking the control circuit.

A string or cord 33 is provided for drawing the magnet against the bias of spring 31 away from its normal position. The string is secured at one end to the headpiece 29 of the magnet. Its opposite end 37 passes slidably through the stop 32 and a seal ring 38 to the outside of the threaded end of the tube. The string end 37 is connected to a pull element, here in the form of a coned cup 39. In this respect, the string passes through an axially extending core 41 of the cup to the exterior of the nosed bottom end of the cup. A knob and washer 43 at the end of the string prevents endwise escape of the cup.

The coned cup is of such size as to enable it to be inserted through the aperture 13 to the interior of the conduit to which the switch device is to be applied.

In the use of the device, after the cup has been inserted through the wall aperture into the conduit, the threaded end of the tube is screwed into the aperture. When this is done, the coned cup will dangle from the end of the string (as in FIG. 1) with its open cup end uppermost in the path of and facing oppositely to the direction of liquid flow in the conduit.

It can be seen that when liquid is flowing in the direction of the arrow through the conduit it will be caught by the cup element 39 so as to exert a pulling force upon the string. When the volume or pressure of the flow through the conduit acting upon the cup is sufficient to overcome the resistance of the spring 31, the cup and string will be pulled into the conduit and will draw the magnet against the bias of spring 31 forwardly into the tube. Accordingly, the flux force of the magnet will be relieved of the contacts, permitting the latter to return to open condition.

When the flow pressure relaxes, spring 31 will return the magnet, together with the connected string and cup to normal position.

The tube 11, sleeve 18, plug 30 and nut 17 are of non-dielectric material, as well as some other components if need be, so as not to undesirably interfere with the intended magnetic action of the magnet upon the switch contacts.

It is to be noted that the magnet may be slidably assembled into or withdrawn from the bore upon removal of plug 30.

I claim:

1. A fluid flow operable switch device comprising a housing, a reed switch mounted to the housing having a pair of contacts at least one of which is magnetically attractible, a magnet movable in an elongated bore of the housing into and out of a zone of effective magnetic flux influence upon the contacts of the switch, a spring biasing the magnet into the zone, a string connected to the magnet and projecting externally of the housing, and a pull element connected to the projecting end of the string responsive to a predetermined fluid flow applied to it in a direction away from the housing to draw the magnet out of said zone.

2. A flow operable switch device as in claim 1, wherein the pull element is adapted to be received through an aperture in a side wall of a conduit into the conduit in the path of fluid flow through the conduit, and the housing has an end connectible with the aperture.

3. A flow operable switch device as in claim 2, wherein the pull element is a cup attachable with the string so that its open cup end is uppermost.

4. A flow operable switch device as in claim 1, wherein a sleeve is fitted about the housing having a radially extending enlargement provided with a recess in which the reed switch is disposed.

5. A flow operable switch device as in claim 1, wherein the bore opens through one end of the housing and the open end is sealed by a plug, the magnet being adapted to be removed from the bore upon removal of the plug.

* * * * *